United States Patent [19]

Gipson

[11] Patent Number: 5,069,602

[45] Date of Patent: Dec. 3, 1991

[54] FLUID-POWERED SUBSURFACE PUMP

[76] Inventor: Thomas C. Gipson, P.O. Box 231, 1-20 East, Cisco, Tex. 76437

[21] Appl. No.: 588,562

[22] Filed: Sep. 26, 1990

[51] Int. Cl.[5] ..... F04B 17/00; F04B 35/00

[52] U.S. Cl. ..... 417/399; 417/401; 417/390; 417/388; 417/383

[58] Field of Search ..... 417/399, 401, 390, 383, 417/385, 386, 387, 388

[56] References Cited

U.S. PATENT DOCUMENTS

| | | | |
|---|---|---|---|
| 3,123,007 | 3/1964 | Orr | 417/383 |
| 4,295,801 | 10/1981 | Bennett | 417/390 |
| 4,551,075 | 11/1985 | Canalizo | 417/383 |
| 4,553,910 | 11/1985 | Gosschalk | 417/388 |

*Primary Examiner*—Richard A. Bertsch
*Assistant Examiner*—Alfred Basichas
*Attorney, Agent, or Firm*—Gunn, Lee & Miller

[57] ABSTRACT

A low volume, hydraulic powered pump for attachment to small diameter, coiled tubing for pumping subsurface liquids from hydrocarbon formations. The pump is easily run into existing production well tubing by use of a coiled tubing unit and then connected to a power fluid pressuring apparatus. Power fluid actuates an actuator in the pump to pump liquids in the formation to the surface. The actuator has two piston heads connected by a connector rod which reciprocate in two separate chambers in the pump which are divided by a cross head seal member. A conduit in the actuator allows power fluid to be forced into the lower chamber to drive the actuator downward pumping subsurface liquids to the surface. Once the actuator completes its down stroke, pressure on the power fluid is released and the actuator is driven to its retract position by the hydrostatic pressure of the subsurface liquids pressing against the bottom surface of the upper piston head. The subsurface hydrostatic pressure acts through a piston return port in the pump housing above the cross head seal member, but beneath the upper piston head.

1 Claim, 2 Drawing Sheets

FLUID-POWERED SUBSURFACE PUMP

BACKGROUND OF THE INVENTION

This invention relates to a downhole liquid pump for use in hydrocarbon production formations and the like. Specifically, the present invention relates to a subsurface, fluid-powered, reciprocating, liquid lifting pump. The fluid powering the return stroke of the pump in the present invention is the liquid being produced or drawn from the subsurface well casing.

Presently, conventional rod actuated pumps are most commonly used in gas and oil wells to lift or withdraw liquid or condensate from the well bore. An obvious disadvantage to this type of rod pump is that the motive force to raise and lower the plunger downhole is a rigid actuator rod, and it will not compensate for bends or sharp angles in the well bore. A generally straight, vertical action of the rod must be maintained.

When hydraulic actuated reciprocating pumps are used, power fluid is usually required to be supplied to both the power and retract sides of the piston stroke. Some free-type hydraulic pumps are actuated by a flow of power fluid from the surface (either produced oil or water) down the tubing to power the pump engine. However, exhaust power fluid mixed with produced fluid returns upward through the casing annulus, or a secondary tubing string, and is separated at the surface.

The present invention utilizes a uniquely designed low volume, hydraulic pump connected to the end of a small diameter coiled tubing run. The diameter of the coiled tubing is generally in range of ½" to 1⅛" outside diameter (OD) with the most typical size being ¾" OD.

Because the pump of the present invention is connected to the coiled tubing, it is easily run into the standard 2⅜" production well tubing, even if the well tubing has been run at an angle considerably off the true, straight, direct vertical. Further, because of the low volume of power fluid retained in the small diameter coiled tubing extending above the submerged pump, the downhole hydrostatic pressure of the produced liquid is sufficient when working against the piston head in the downhole pump to retract the pump actuator. Thus, external power only needs to be applied in the pump stroke.

SUMMARY OF THE INVENTION

The present invention is a fluid-powered pump for attachment to small diametered coiled tubing for pumping subsurface liquids from hydrocarbon formations. The pump utilizes an actuator inside of a pump housing with the actuator having upper and lower piston heads connected by a connector rod. The pistons reciprocate in separate chambers divided by a cross head seal member. A conduit through the connector rod enables power fluid pressurized from the surface to enter the lower chamber, above the lower piston head, and urge the actuator downwardly pumping the subsurface liquids below the lower piston head out of the lower chamber through an outlet valve to the surface.

When the pressure on the power fluid is released, the subsurface liquids are forced by hydrostatic pressure through a piston return port in the pump housing above the cross head seal member but beneath the upper piston head in the upper chamber. As the subsurface liquids press against the bottom surface of the upper piston head, the actuator is retracted, drawing more subsurface liquid into the lower chamber through an inlet valve.

DETAILED DESCRIPTION OF THE PREFERRED EMBODIMENT

Figure 1A:
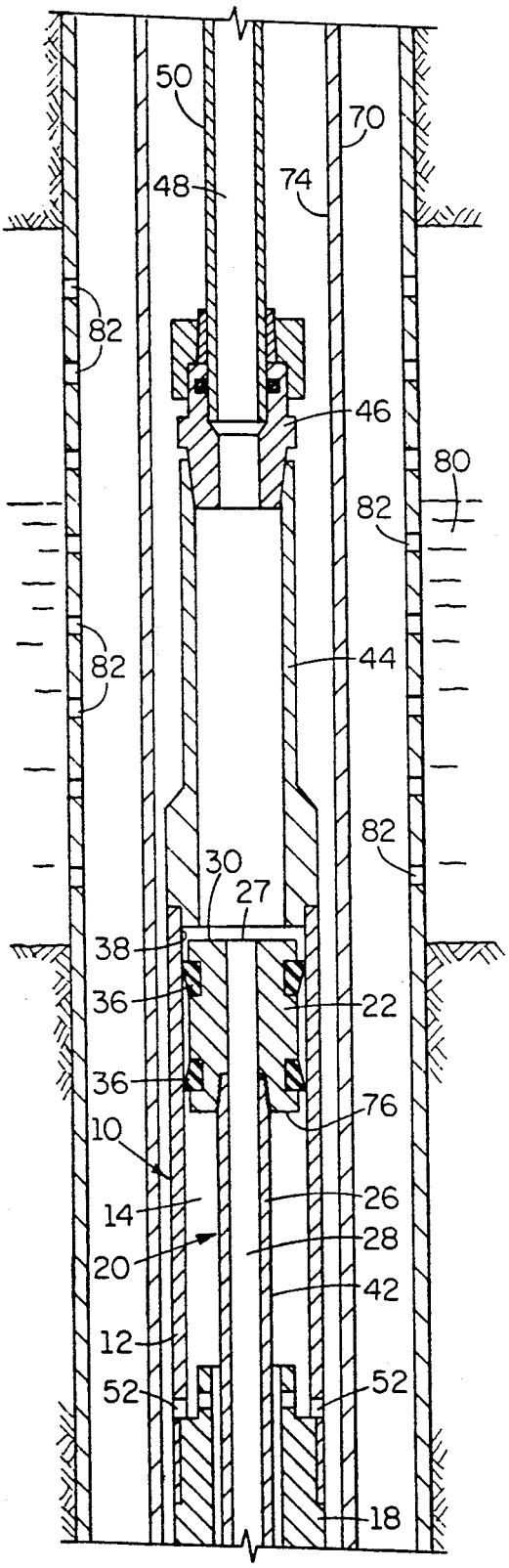
FIG. 1A illustrates a cross-sectional view of the upper portion of the pump cf the present invention in its retracted position and in place in the production well tubing within the well casing.
Figure 2A:
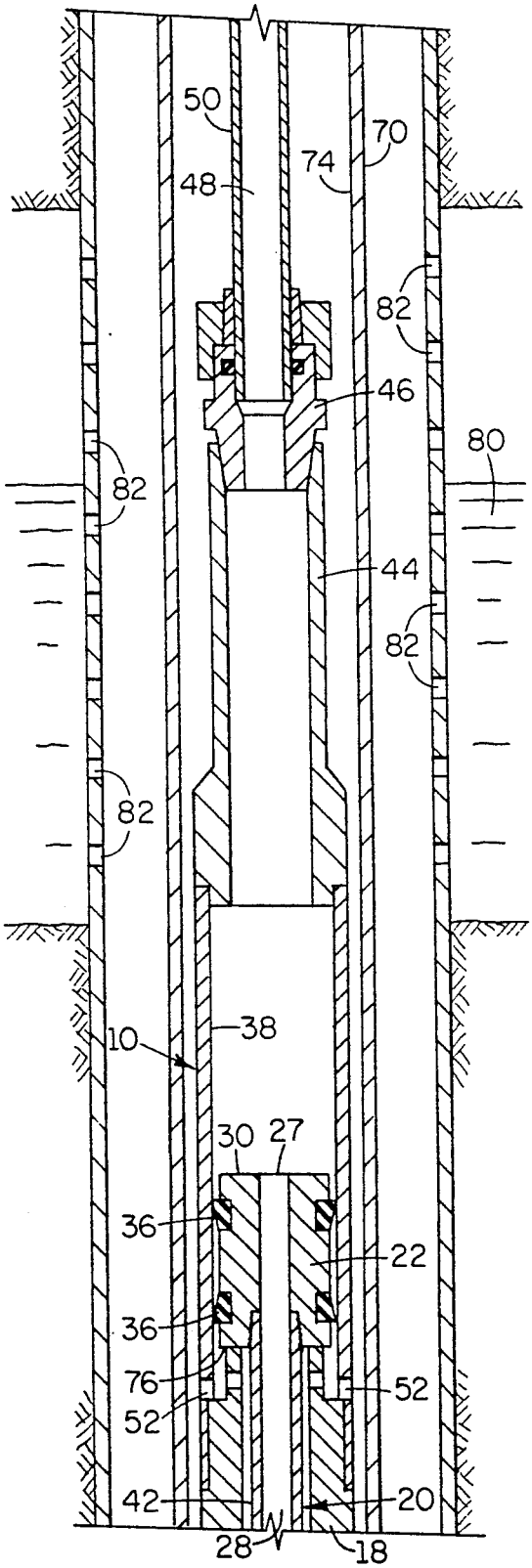
FIG. 2A illustrates a cross-sectional view of the upper portion of the pump of the present invention in its pumping position and in place in the production well tubing within the well casing.
Figure 1B:
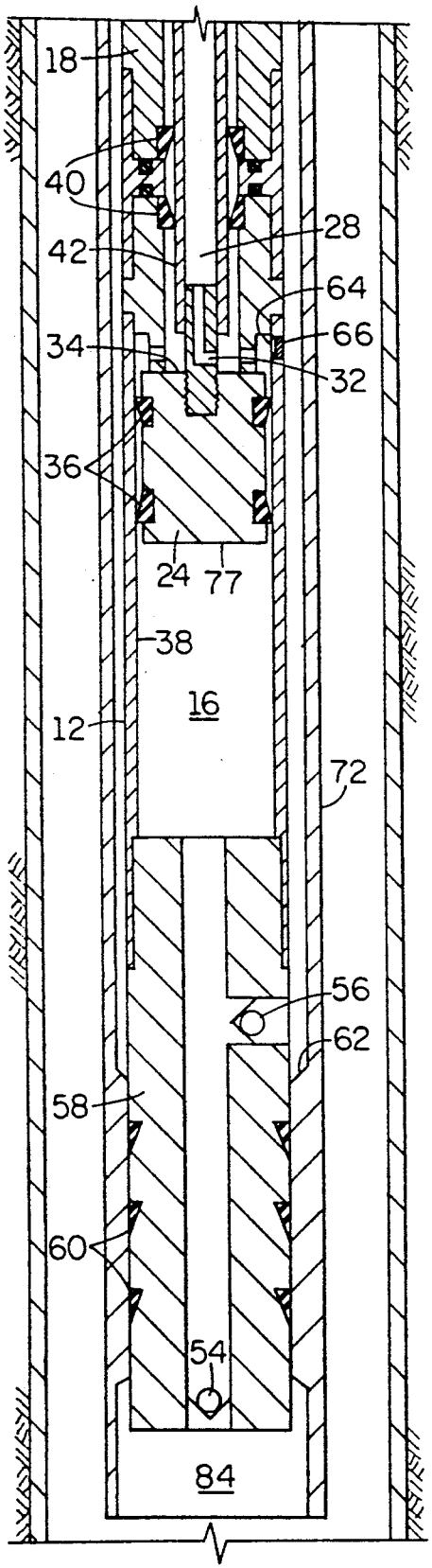
FIG. 1B illustrates a cross-sectional view of the lower portion of the pump cf the present invention in its retracted position and in place in the production well tubing within the well casing.
Figure 2B:
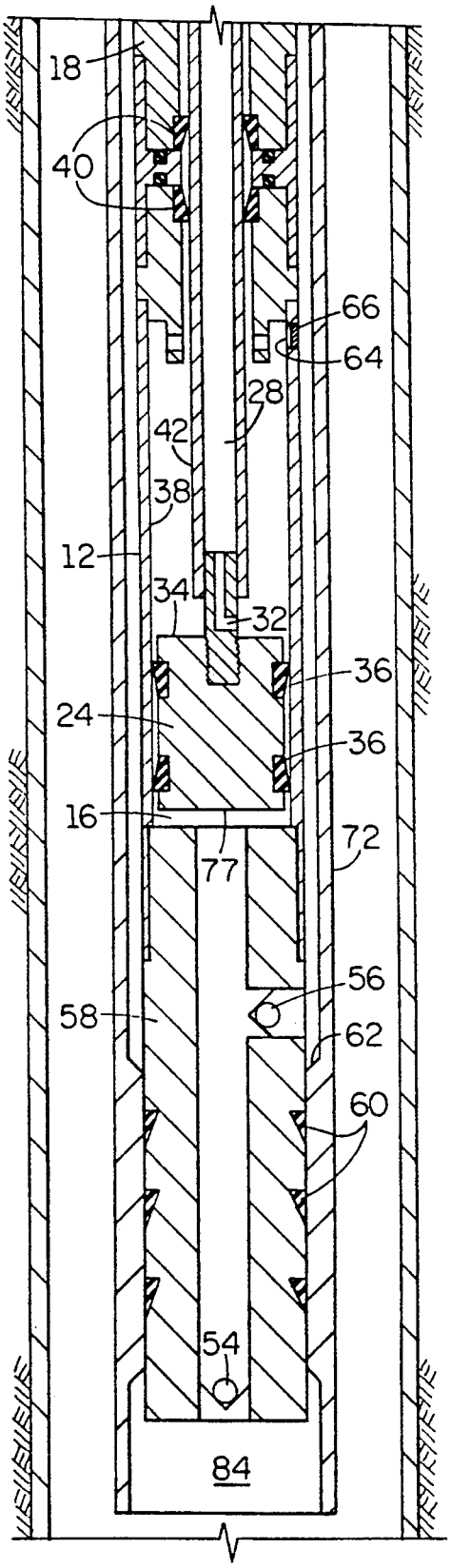
FIG. 2B illustrates a cross-sectional view of the lower portion of the pump of the present invention in its pumping position and in place in the production well tubing within the well casing.

FIGS. 1A and 1B are to be viewed as being combined at the break lines to illustrate the present invention in a first position or a "fill" or "retracted" position. FIGS. 2A and 2B are to be viewed as combined at the break lines to illustrate the present invention in a second position or "power stroke" or "pumping" position.

The pump 10 of the present invention has a cylindrical outer housing 12 as shown in FIGS. 1A and 1B. The housing in the present embodiment is about 16 feet long. The inside diameter of the housing is approximately 1.50". Larger or smaller pumps may be constructed depending upon the particular application. The inside of the pump is divided into two chambers 14 and 16 by cross head guide member 18.

A single, spool-like actuator 20 extends between and reciprocates in chambers 14 and 16. The actuator 20 has an upper piston head 22 and a lower piston head 24. In the preferred embodiment the piston heads 22 and 24 each have a head surface area in the 1.0–1.5 square inch range.

A piston connector rod 26 connects the two heads 2 and 24. A conduit 28 is formed in the actuator 20 and extends from the top surface 30 of the upper piston head 22 through the piston connector rod 26 and discharges through power fluid port 32 above the top surface 34 of the lower piston head 24. Appropriate seals or piston rings 36 seal the piston head and the inner walls 38 of the chambers 14 and 16. Seals 40 in the cross head guide engage the connector rod 26 to seal along its outer surface 42. The upper chamber 14 is in fluid communication through pump neck 44 and pump connector 46 with the inside 48 of the coiled tubing 50 since the housing 12 is connected to the end of a coiled tubing 50 run. The coiled tubing 50 is a small diameter tube in the range of ½" to 1½" OD. The typical size used is ¾". The tubing nominal inside area is 0.26 square inches.

The upper chamber 14 is further provided with a piston return port 52 extending through the housing wall 38 above the cross head guide member 18 and below the bottom of the piston head 22. This piston return port 52 is open at all times.

The lower chamber 16 is provided with a standard fluid suction valve 54 and discharge valve 56 with appropriate check valving to allow only one way fluid flow. The external housing section 58 of the lower portion of the pump 10 is provided with standard seating seals for engagement with the standard seating nipple 62 used in conventional oil well operations.

Above the lower piston head 24 and immediately below the cross head guide 18 is an air bleeder port 64 which is plugged with plug 66 after air is removed from the pump 10 upon installation as will be discussed below.

In operation, the pump neck 44 is connected to the coiled tubing 50 at connector 46 and power fluid is pumped into the coiled tubing 50. The air bleed port 64 is opened. Power fluid flows into the upper chamber 14 above the top surface 30 of the upper piston head 22. Power fluid also flows through the conduit 28 in rod 26 out port 32, and into the lower chamber 16 above the top surface 34 of the lower piston head 24.

As fluid pressure is applied, the actuator 20 begins to move downward and power fluid fills the top and bottom chambers by passing through the conduit in the actuator. When the actuator 20 has made its full stroke as shown in FIGS. 2A and 2B and all of the air is removed from chambers 14 and 16, the bleeder port 64 is closed or plugged with plug 66. Fluid pressure from the power fluid on the top sides 30 and 34 of the piston heads is then released through appropriate valving at the surface at the well head.

The coiled tubing 50 with pump 10 attached to the downhole end of the coiled tubing, is run into the well head through the normal 2⅜" OD well tubing 70. The pump 10 is lowered until the seating seal 60 engages the seating nipple 62 at a lower end 72 of the well tubing 70. The area between the outer housing 12 of the pump 10 and coiled tubing 50 and the inside 74 of the well tubing 70 is either filled by liquid from the formation or filled from the surface above.

The pressure of the fluid in this column of liquid inside the 2⅜" OD well tubing 70 is calculated as follows: weight of fluid/gallon ×5.2 (hydrostatic constant) X depth of tubing/100 feet=pressure per square inch. Thus, if the liquid inside the well tubing is oil weighing approximately 6 pounds per gallon, the pressure at 5000 feet would be approximately 1560 p.s.i. If the liquid inside the well tubing is water weighing approximately 8.33 pounds per gallon, the pressure at 5000 feet would be approximately 2166 p.s.i.

At 5000 feet, the weight of the column of power fluid inside the ⅜" OD coiled tubing 50 would be approximately 405 pounds, if oil, or 563 pounds, if water. This is calculated as follows: length of coiled tubing column X (weight of liquid per gallon×gallons of liquid per unit length. For oil: 5000'×6 pounds/gallon×13.5 gallons/1000 feet=405 pounds of oil.

Because the area of the bottom surface 76 of piston head 22 is in the range of 1.0 to 1.5 square inches, liquid in the well tubing 70, also called produced liquid or fluid, passes through the piston return port 52 forcing against the bottom side 76 of the top piston 22 forcing the piston 22 upwardly (return stroke). This is because the weight of the column of power fluid in the small diameter coiled tubing 50 extending to the surface is less than the lifting force on the piston 22. It must be recalled that the power fluid in the coiled tubing column is allowed to be pushed up the coiled tubing, because of appropriate power fluid valving at the well head top side.

Liquids 80 in the formation pass through perforations 82 in the well casing as is well known in the art, and they are drawn up into the inside 84 of the well tubing 70 and eventually pumped to the surface by operation of the pump 10 as discussed below.

With the actuator 20 in the retract position (FIGS. 1A and 1B) with the piston heads 22 and 24 at the top of the cycle, power fluid in the coiled tubing 50 is pressurized sufficiently to drive the actuator 20 downwardly in the pump stroke until it reaches the second position shown in FIGS. 2A and 2B.

Power fluid forces against the top surface 30 of the upper piston head 22, and a portion passes through the conduit 28 in the connector rod 26 and forces against the top surface 34 of the bottom piston head 24. Produced liquid inside the upper chamber 14 beneath the bottom surface 76 of upper piston head 22 is forced out piston return port 52 and produced liquid in the lower chamber 16 beneath the bottom surface 77 of lower piston head 24 is forced out the pump discharge valve 56 above the seating nipple 62. The inlet valve 54 is forced closed by the check valve operation so that produced liquid does not get pumped back out of the pump inlet 54.

When the actuator 20 reaches its full stroke (FIGS. 2A and 2B) the apparatus at the surface which is pressurizing the power fluid senses a back-pressure increase and releases the top side pressure on the power fluid.

The actuator 20 is returned to its first position (FIGS. 1A and 1B) as discussed above by the pressure of the produced fluid against the bottom surface 76 of the upper piston head 22 in the upper chamber 14 as the produced fluid passes through the piston return port 52. More produced liquid is drawn into the lower chamber 16 by the upward (drawing) movement of the lower piston head 24. Produced liquid is drawn into the lower chamber 16 through the one way inlet or suction valve 54. The outlet valve 56 is closed by the check valve operation as is well known in the art.

During the upward stroke of the actuator 20, the power fluid above the top surface 34 of the lower piston head 24 passes in through port 32 and conduit 28 in the connecting rod 26, out orifice 27, and into the upper chamber 14 above the top surface 30 of the upper piston head 22 and up through neck 44 and coiled tubing 50.

Thus it may be seen that the present invention utilizes the pressure of the produced liquid to return the pump actuator to its first position (retract o fill position) and at the same time draws more produced liquid into the lower chamber of the pump. The volume of produced liquid pumped is the volume of the liquid in the lower chamber; the volume of the upper chamber always returns to beneath the upper piston as it returns the actuator to the pumping stroke position. From the foregoing it may be seen how the present invention provides a fluid-powered, subsurface pump.

While the invention has been described in connection with a preferred embodiment, it is not intended to limit the invention to the particular form set forth, but, on the contrary, it is intended to cover alternatives, modifications, and equivalents, as may be included within the spirit and scope of the invention as defined by the appended claims.

I claim:

1. A fluid-powered pump for attachment to small diametered coiled tubing for pumping subsurface liquid from a well production tube comprising:

a pump housing having an upper end and a lower end, said upper end releasably attachable to a downhole end of said coiled tubing, the inside of said upper end of said housing in fluid communication with the inside of said coiled tubing;

a cross head seal member dividing said pump into an upper chamber and a lower chamber, said upper chamber in fluid communication with said inside of said coiled tubing;

a pump actuator extending between said upper and lower chambers, said actuator having an upper piston head sealingly fitted to reciprocate in said upper chamber and a lower piston head sealingly fitted to reciprocate in said lower chamber, said upper piston head and said lower piston head connected to each other by a connector rod sealing slidable in said cross head seal member, said actuator having a conduit for fluid communication between said upper chamber and said lower chamber, said conduit extending from an orifice in the top surface of said upper piston head, through said connector rod to a port above the top surface of said lower piston head;

an inlet valve in said housing for allowing said subsurface liquid to selectively enter said lower chamber when said actuator is moved from a second position to a first position;

an outlet valve in said housing for allowing said subsurface liquid to selectively exit said lower chamber when said actuator is moved from said first position to said second position; and a piston return port in said housing beneath said upper piston head and above said cross head seal member for fluid communication between said upper chamber and the exterior of said housing.

* * * * *